US007690887B2

(12) United States Patent
Takahashi et al.

(10) Patent No.: US 7,690,887 B2
(45) Date of Patent: Apr. 6, 2010

(54) TURBO COMPRESSOR

(75) Inventors: Toshio Takahashi, Tokyo (JP); Yutaka Hirata, Tokyo (JP); Kazuo Kobayashi, Tokyo (JP); Kazuaki Kurihara, Tokyo (JP); Kentaro Oda, Tokyo (JP)

(73) Assignee: Ishikawajima-Harima Heavy Industries, Co., Ltd., Tokyo (JP)

( * ) Notice: Subject to any disclaimer, the term of this patent is extended or adjusted under 35 U.S.C. 154(b) by 606 days.

(21) Appl. No.: 11/566,428

(22) Filed: Dec. 4, 2006

(65) Prior Publication Data

US 2007/0147985 A1 Jun. 28, 2007

(30) Foreign Application Priority Data

Dec. 28, 2005 (JP) ..... 2005-377217

(51) Int. Cl.
*F01D 3/04* (2006.01)

(52) U.S. Cl. ..... 415/99; 415/100; 415/104; 415/105; 415/106; 415/122.1

(58) Field of Classification Search ..... 415/99, 415/100, 104, 105, 106, 107, 122.1, 124.1, 415/229

See application file for complete search history.

(56) References Cited

U.S. PATENT DOCUMENTS

| | | | | |
|---|---|---|---|---|
| 1,012,271 | A | 12/1911 | Paul | |
| 1,129,139 | A | 2/1915 | Sulzer | |
| 1,525,736 | A | 2/1925 | Hollander | |
| 1,998,754 | A | 4/1935 | Dorer | |
| 2,391,811 | A * | 12/1945 | Wilhelm | 415/94 |
| 2,804,826 | A * | 9/1957 | Cilker | 415/99 |
| 2,995,092 | A * | 8/1961 | Thomas et al. | 415/94 |
| 3,176,620 | A * | 4/1965 | Shiley | 415/99 |
| 3,898,793 | A * | 8/1975 | Nakamura et al. | 60/39.08 |
| 6,062,028 | A | 5/2000 | Arnold et al. | |
| 6,499,955 | B2 | 12/2002 | Choi et al. | |
| 6,709,236 | B1 * | 3/2004 | Holzer | 415/229 |
| 6,739,845 | B2 * | 5/2004 | Woollenweber | 417/407 |
| 6,920,754 | B2 | 7/2005 | Arnold et al. | |
| 6,997,686 | B2 | 2/2006 | Agrawal et al. | |
| 2002/0037215 | A1 | 3/2002 | Choi et al. | |

FOREIGN PATENT DOCUMENTS

| | | |
|---|---|---|
| CN | 2445117 A | 8/2001 |
| CN | 1346020 A | 4/2002 |
| JP | 05-223090 | 8/1993 |
| JP | 2002-303298 | 10/2002 |

OTHER PUBLICATIONS

Office Action issued in related co-pending U.S. Appl. No. 11/566,337, mailed May 18, 2009.

English translation of Notice of Rejection issued in related co-pending Chinese Application dated May 9, 2008.

* cited by examiner

*Primary Examiner*—Igor Kershteyn
(74) *Attorney, Agent, or Firm*—Griffin & Szipl, P.C.

(57) ABSTRACT

A first centrifugal impeller and a second centrifugal impeller are arranged in such an orientation that back sides of the first centrifugal impeller and the second centrifugal impeller face to each other. Bearings are cylindrical roller bearings and a thrust bearing. The cylindrical roller bearings are arranged at two axially spaced supporting positions respectively, and support a radial load applied to the rotating shaft. The thrust bearing supports a thrust load applied to the rotating shaft.

6 Claims, 7 Drawing Sheets

TURBO COMPRESSOR

This application claims priority from Japanese Patent Application No. 2005-377217, filed Dec. 28, 2005, the entire disclosure of which is incorporated herein by reference.

BACKGROUND OF THE INVENTION

1. Technical Field of the Invention

The present invention relates to a turbo compressor, and more particularly to a turbo compressor in which a service life of bearings is elongated and a critical speed of a rotating shaft is improved.

2. Description of Related Art

In a refrigerating machine, there is employed a centrifugal compressor, so-called turbo compressor, for compressing a coolant gas serving as a working fluid to bring the compressor in the high temperature and high pressure state.

Meanwhile, in the compressor, if a compression ratio is higher, a discharge temperature of the compressor becomes higher and a volumetric efficiency is lowered. Particularly, if the evaporation temperature becomes lower, the compression ratio becomes higher, and accordingly, there is a case that a compressing operation is divided into two stages, three stages or more stages. The turbo compressor in which the compressing operation is executed by multiple stages in this manner is called as a multistage turbo compressor.

As a prior art of a two-stage turbo compressor, there is one disclosed in the following patent document 1, and the structure thereof is shown in FIG. 1.

In this turbo compressor 80, a first stage centrifugal impeller 83 and a second stage centrifugal impeller 84 are fixed to a rotating shaft 82, which is rotatably provided in a housing 81, such that the first stage centrifugal impeller 83 and the second stage centrifugal impeller 84 are arranged at an interval therebetween and in the same orientation.

The rotating shaft 82 is rotatably supported at axially spaced apart positions thereof by a bearing A and a bearing B, in such a state that a portion of the rotating shaft 82 to which the first stage centrifugal impeller 83 and the second stage centrifugal impeller 84 are fixed overhangs.

The bearing A is constituted by a combined angular ball bearing using angular ball bearings, and the bearing B is constituted by a combined angular ball bearing using two angular ball bearings.

Further, an output shaft 86 of a motor 85 serving as a drive source is rotatably supported by a bearing 87. A large gear 88 is fixed to the output shaft 86, and a small gear 89 engaging with the large gear 88 is fixed to the rotating shaft 82, whereby the rotational force of the output shaft 86 of the motor 85 is transmitted to the rotating shaft 82, with the increased speed.

In the turbo compressor 80 structured as mentioned above, the coolant is compressed by the first stage centrifugal impeller 83 on the upstream side, then introduced into the second stage centrifugal impeller 84 to be further compressed, and then delivered to the outside.

Further, there is disclosed in the following patent document 2 a structure in which impellers are fixed to opposite end portions of a rotating shaft of a turbo compressor, an output shaft of a motor is coupled to a center portion of the rotating shaft, and bearings are arranged near the opposite end portions of the rotating shaft.

Patent Document 1: Japanese Laid-Open Patent Publication No. 2002-303298

Patent Document 2: Japanese Laid-Open Patent Publication No. 5-223090

In the compressor, the pressure on the back side of the impeller is higher than the pressure on the front side of the impeller. This pressure difference generates a thrust force in the impeller from the back side toward the inlet side. Accordingly, if two impellers are arranged in the same orientation such as those in the turbo compressor in the patent document 1, the thrust forces applied to both the impellers are combined to generate a great thrust force. Therefore, as to the bearing which supports a larger thrust load applied to the rotating shaft of the compressor, a mechanical loss becomes larger as the support load becomes larger, and there is a problem that a service life of the bearing becomes short. Further, if the number of the bearings arranged is increased in order to elongate the service life of the bearings, there is a problem that the mechanical loss becomes large.

Further, in the turbo compressor in the patent document 2, the angular ball bearing is employed as the bearing. The angular ball bearing can receive not only a radial load but also a thrust load, however, in order to receive the thrust load in opposite directions, it is necessary to use two or more angular ball bearings in combination. Accordingly, the number of the bearings to be used is increased, and there is a problem that the mechanical loss is large.

Further, in the structure in which a plurality of impellers are attached to the overhang portion of the rotating shaft, such as in the turbo compressor in the patent document 1, it is necessary to take a step such as a step for shortening the axial length of the impellers in the case of taking the critical speed of the rotating shaft into consideration.

However, it is not preferable in the light of the compression efficiency to shorten the axial length of the impeller.

Further, in the turbo compressor in the patent document 2, the distance between the shaft support portions is elongated because of being supported near opposite end portions of the rotating shaft, causing a problem that the critical speed is lowered.

SUMMARY OF THE INVENTION

The present invention is made by taking the circumstances mentioned above into consideration, and an object of the present invention is to provide a turbo compressor which can elongate a service life of bearings by reducing a mechanical loss in the bearing part, and can increase a critical speed without shortening the axial length of impellers.

In order to achieve the object mentioned above, the turbo compressor in accordance with the present invention employs the following means.

That is, a turbo compressor, in accordance with the present invention, comprises: a rotating shaft provided in a housing and rotationally driven by a drive source; bearings rotatably supporting the rotating shaft; and a first centrifugal impeller and a second centrifugal impeller arranged on the rotating shaft to be axially spaced from each other, wherein the first centrifugal impeller and the second centrifugal impeller are arranged in such an orientation that back sides of the first centrifugal impeller and the second centrifugal impeller face to each other, and the bearings are cylindrical roller bearings and a thrust bearing, the cylindrical roller bearings being arranged at two axially spaced supporting positions respectively and supporting a radial load applied to the rotating shaft, the thrust bearing supporting a thrust load applied to the rotating shaft.

In this manner, since the first centrifugal impeller and the second centrifugal impeller are arranged in such an orientation that their back sides face to each other, the thrust forces applied to both the impellers have opposite directions to each other. Accordingly, the thrust forces applied to both the impellers are cancelled and reduced, and the thrust load applied to the bearings is widely reduced, so it is possible to reduce a mechanical loss in the bearing part. Therefore, it is possible to elongate the service life of the bearing.

Further, since the bearings are categorized into the bearings supporting the radial load and the bearing supporting the thrust load, it is possible to select optimum bearings while taking the loss and the service life into consideration in correspondence to each of the loads. In accordance with the present invention, since the thrust load is reduced as mentioned above, the thrust load is supported only by the thrust bearing, and the bearings supporting the radial load can be constituted by cylindrical roller bearings. Accordingly, since it is not necessary to use many bearings constituted in combination as in the case of the angular ball bearings, and the number of the bearings to be used can be reduced, it is possible to reduce the mechanical loss in the bearing part.

Further, since the cylindrical roller bearing can support a larger radial load than the ball bearing, it is possible to make the bearing smaller than the ball bearing, in the case of supporting the same radial load.

Further, a turbo compressor, in accordance with the present invention, comprises: a rotating shaft provided in a housing and rotationally driven by a drive source; bearings rotatably supporting the rotating shaft; and a first centrifugal impeller and a second centrifugal impeller arranged on the rotating shaft to be axially spaced from each other, wherein the first centrifugal impeller and the second centrifugal impeller are arranged in such an orientation that back sides of the first centrifugal impeller and the second centrifugal impeller face to each other, and the bearings support the rotating shaft at two axially spaced supporting positions, and at least one of the bearings is a deep groove ball bearing.

In this manner, since the first centrifugal impeller and the second centrifugal impeller are arranged in such an orientation that their back sides face to each other, it is possible to reduce the mechanical loss in the bearing part, as mentioned above. Therefore, it is possible to elongate the service life of the bearings.

Further, since the thrust load in the bearing part is widely reduced, and the deep groove ball bearing is employed, it is not necessary to use many bearings constituted in combination as in the case of the angular ball bearings, and therefore, it is possible to reduce the number of the bearings to be used, and to reduce the mechanical loss in the bearing part.

Further, in the turbo compressor mentioned above, the first centrifugal impeller and the second centrifugal impeller are arranged in this order from one end side of the rotating shaft, the rotating shaft is structured such that a driving force is transmitted thereto at a position on the opposite side from the first centrifugal impeller with respect to the second centrifugal impeller in the axial direction, and the bearing supporting the rotating shaft at one of the supporting positions is arranged between the first centrifugal impeller and the second centrifugal impeller, and the bearing supporting the rotating shaft at the other of the supporting positions is arranged on the opposite side from the first centrifugal impeller with respect to the second centrifugal impeller in the axial direction.

Further, a turbo compressor, in accordance with the present invention, comprises: a rotating shaft provided in a housing and rotationally driven by a drive source; bearings rotatably supporting the rotating shaft; and a first centrifugal impeller and a second centrifugal impeller arranged on the rotating shaft to be axially spaced from each other, wherein the first centrifugal impeller and the second centrifugal impeller are arranged in this order from one end side of the rotating shaft in such an orientation that back sides of the first centrifugal impeller and the second centrifugal impeller face to each other, the rotating shaft is structured such that a driving force is transmitted thereto at a position on the opposite side from the first centrifugal impeller with respect to the second centrifugal impeller in an axial direction, and the bearing supporting the rotating shaft at one of the supporting positions is arranged between the first centrifugal impeller and the second centrifugal impeller, and the bearing supporting the rotating shaft at the other of the supporting positions is arranged on the opposite side from the first centrifugal impeller with respect to the second centrifugal impeller in the axial direction.

In this manner, since the bearing supporting the rotating shaft at the one of the supporting positions is arranged between the first centrifugal impeller and the second centrifugal impeller, the amount of overhang of the rotating shaft is reduced. Accordingly, it is possible to increase the critical speed without shortening the axial length of the impellers. Further, since the bearing can be arranged in the thin shaft portion over which the impellers are inserted, it is possible to suppress the deflection of the rotating shaft, and the rigidity is increased.

Further, since the bearing supporting the rotating shaft at the other of the supporting positions is arranged on the opposite side from the first centrifugal impeller with respect to the second centrifugal impeller in the axial direction, it is possible to make the shaft portion at this supporting position thick, and the rigidity is increased.

Further, in the turbo compressor mentioned above, the turbo compressor further comprises a speed increasing mechanism for transmitting the rotational driving force output from the drive source to the rotating shaft while increasing the rotational speed output by the drive source, wherein the speed increasing mechanism is arranged between the second centrifugal impeller and the bearing supporting the rotating shaft at the other of the supporting positions.

In this manner, since the speed increasing mechanism is arranged between the second centrifugal impeller and the bearing supporting the rotating shaft at the other of the supporting positions, it is possible to suppress the deflection of the rotating shaft due to a reaction force of the speed increasing mechanism.

Incidentally, "first" and "second" mentioned above indicate one and the other of two. Therefore, "first centrifugal impeller" means one centrifugal impeller of two centrifugal impellers, and "second centrifugal impeller" means the other centrifugal impeller of two centrifugal impellers. Accordingly, "first stage centrifugal impeller" in the following description does not necessarily mean the first centrifugal impeller, and "second stage centrifugal impeller" does not necessarily mean the second centrifugal impeller mentioned above.

In accordance with the turbo compressor of the present invention, there can be obtained an excellent effect that it is possible to increase a critical speed without shortening the axial length of the impellers as well as it is possible to reduce a mechanical loss in the bearing part so as to elongate a service life of the bearings.

The other objects and advantages of the present invention will be apparent from the following description with reference to the accompanying drawings.

DESCRIPTION OF PREFERRED EMBODIMENTS

Figure 1:
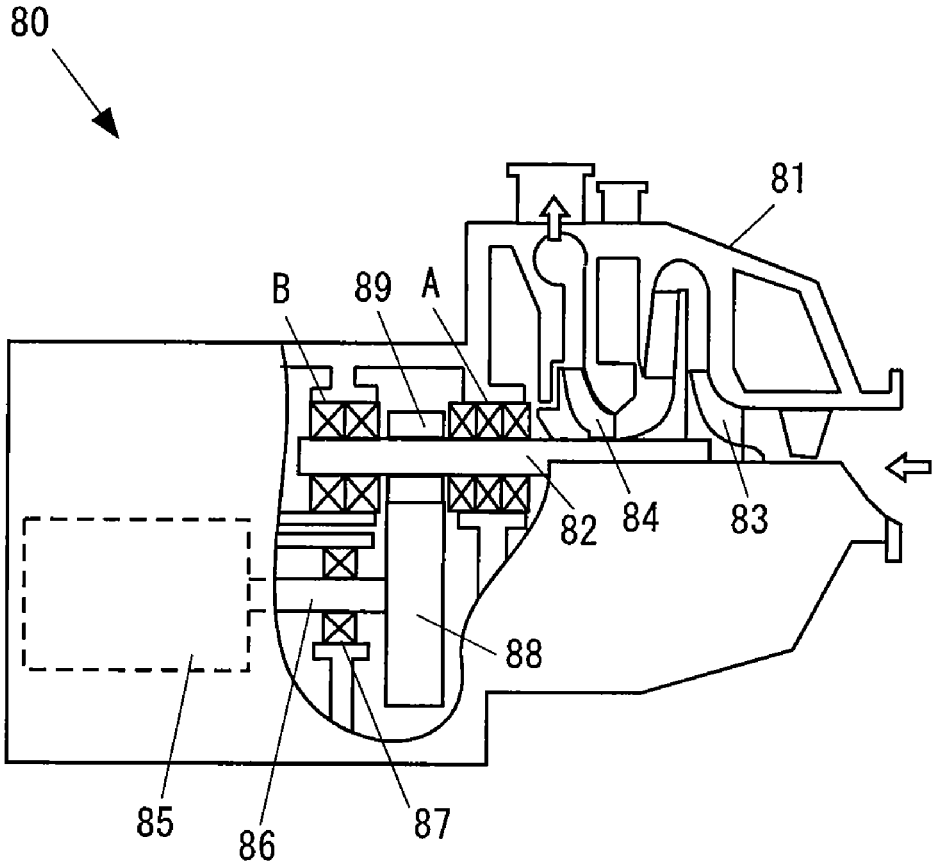
FIG. 1 PRIOR ART
FIG. 1 is a view showing a structure of a conventional turbo compressor.

The description will be in detail given below of preferred embodiments in accordance with the present invention with reference to the accompanying drawings. In this case, the same reference numerals are attached to the common portions in each of the drawings, and the repeated description will be omitted.

Further, the present invention is described below as a turbo compressor for a refrigerator, however, the applied range of the present invention is not limited to this, but the present invention can be applied to a centrifugal type turbo compressor for compressing a fluid used in the other industrial machines.

First Embodiment

The description will be given below of an embodiment in accordance with the present invention.

Figure 2:
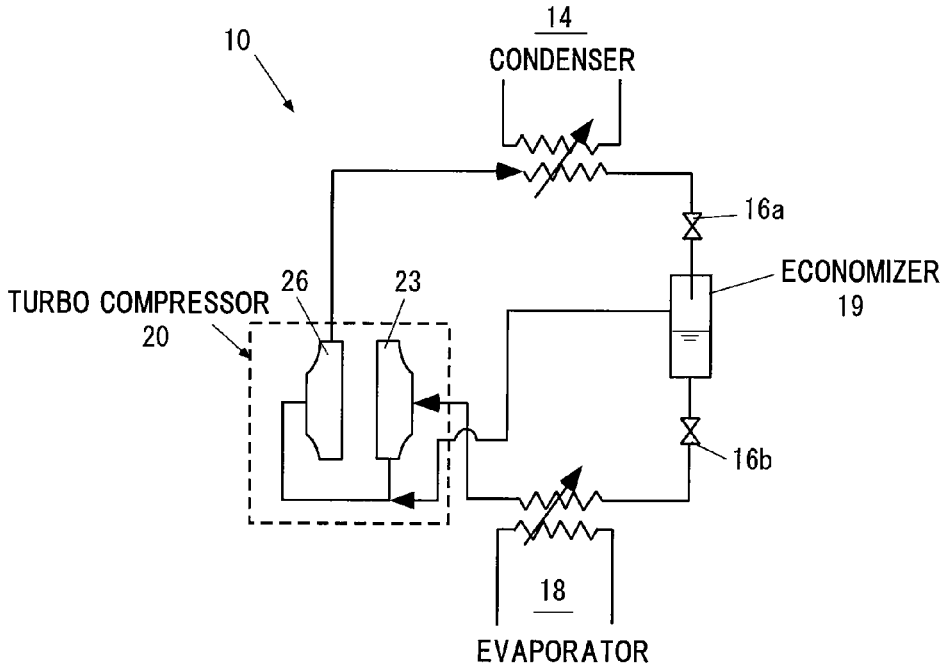
FIG. 2 is a view showing an arrangement of a refrigerating circuit of a turbo refrigerator to which a turbo compressor in accordance with the present invention is applied.

FIG. 2 is a view showing an arrangement of a refrigerating circuit of a turbo refrigerator 10 to which a turbo compressor in accordance with the present invention is applied.

In FIG. 2, the turbo refrigerator 10 is provided with a turbo compressor 20, a condenser 14, expansion valves 16*a* and 16*b*, an evaporator 18 and an economizer 19.

The turbo compressor 20 is a two-stage turbo compressor provided with a first stage centrifugal impeller 23 and a second stage centrifugal impeller 26, wherein the coolant gas is compressed by the first stage centrifugal impeller 23 on the upstream side, introduced into the second stage centrifugal impeller 26 and further compressed, and thereafter delivered to the condenser 14.

The condenser 14 cools and liquefies the compressed high-temperature and high-pressure coolant gas into a coolant liquid.

The expansion valves 16*a* and 16*b* are respectively arranged between the condenser 14 and the economizer 19, and between the economizer 19 and the evaporator 18, for depressurizing the coolant liquid liquefied by the condenser step by step.

The economizer 19 temporarily reserves the coolant depressurized by the expansion valve 16*a* so as to cool it. In this case, a gas phase component of the coolant in the economizer 19 is introduced into the flow path between the first stage centrifugal impeller 23 and the second stage centrifugal impeller 26 of the turbo compressor 20.

The evaporator 18 gasifies the coolant liquid into the coolant gas. The coolant gas coming out of the evaporator 18 is sucked into the turbo compressor 20.

Figure 3:
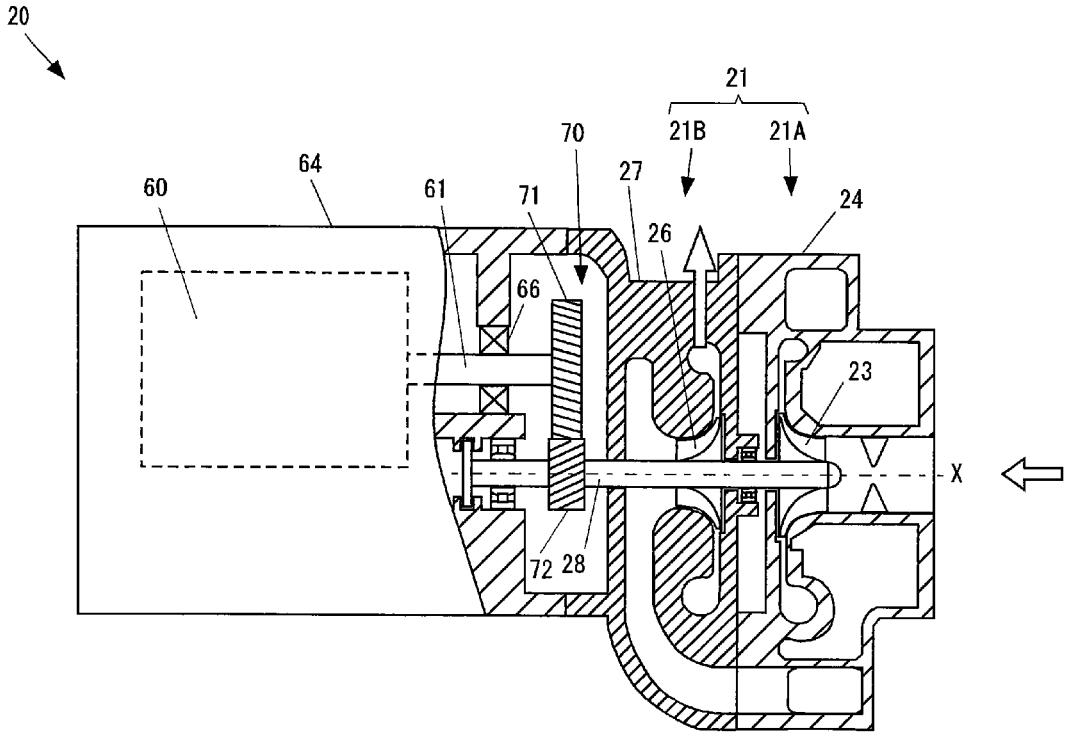
FIG. 3 is a view showing a structure of a turbo compressor in accordance with a first embodiment of the present invention.

FIG. 3 is a cross sectional view showing a structure of the turbo compressor 20 in accordance with the embodiment of the present invention. As shown in FIG. 3, the turbo compressor 20 is constituted by elements such as a compressing mechanism 21, a motor 60 and a speed increasing mechanism 70.

The compressing mechanism 21 is provided with a first stage compression stage 21A constituted by the first stage centrifugal impeller 23 and an inlet side housing 24 surrounding the first stage centrifugal impeller 23, and a second stage compression stage 21B constituted by the second stage centrifugal impeller 26 and an outlet side housing 27 surrounding the second stage centrifugal impeller 26.

A rotating shaft 28 is provided in the inlet side housing 24 and the outlet side housing 27, and supported by bearings 50, described later, so as to be rotatable about an axis X. The first stage centrifugal impeller 23 and the second stage centrifugal impeller 26 are arranged adjacent to each other on the rotating shaft 28 from one end side (suction side in the drawing) of the rotating shaft 28 in an axially spaced apart relationship, and in such an orientation that their back sides face to each other.

The inlet side housing 24 and the outlet side housing 27 are fixed to each other by a fastening means such as bolts or the like.

The motor 60 having an output shaft 61 is accommodated in a motor case 64. The motor 60 serves as a drive source rotationally driving the compressing mechanism 21.

The motor case 64 is fixed to the outlet side housing 27 mentioned above by a fastening means such as bolts or the like.

The speed increasing mechanism 70 is housed in the space formed by the motor case 64 and the outlet side housing 27, and is constituted by a large gear 71 fixed to the output shaft 61, and a small gear 72 fixed to the rotating shaft 28. In this case, the small gear 72 may be integrally formed with the rotating shaft 28. The small gear 72 is fixed to a portion of the rotating shaft 28 on the opposite side from the first stage centrifugal impeller 23 with respect to the second stage centrifugal impeller 26 in the axial direction. In other words, the rotating shaft 28 is structured such that the driving force is transmitted thereto at the position on the opposite side from the first stage centrifugal impeller 23 with respect to the second stage centrifugal impeller 26 in the axial direction.

The rotating force of the output shaft 61 of the motor 60 is transmitted to the rotating shaft 28 by the speed increasing mechanism 70 structured mentioned above, with the speed being increased.

Figure 4:
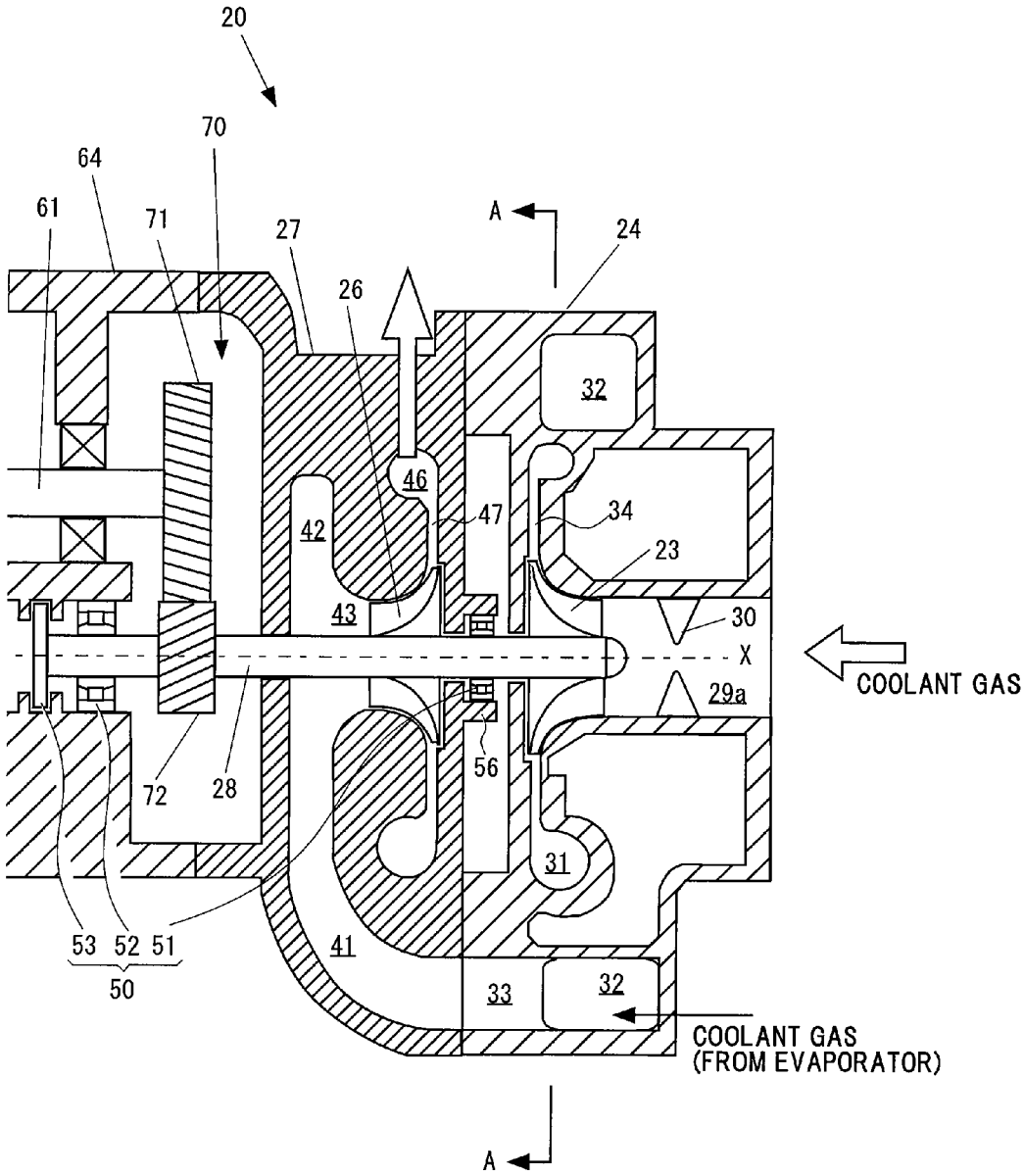
FIG. 4 is a partial enlarged view showing the structure of the turbo compressor in accordance with the first embodiment of the present invention.

FIG. 4 is an enlarged view of the compressing mechanism 21 and the speed increasing mechanism 70 in FIG. 3.

As shown in FIG. 4, in the inlet side housing 24, there is formed a suction port 29*a* for introducing the coolant gas into the first stage centrifugal impeller 23. An inlet guide blade 30 is provided in the suction port 29*a* for controlling the suction capacity.

An annular inner scroll chamber 31 is formed in the inlet side housing 24, surrounding the first stage centrifugal impeller 23. An annular inlet side diffuser portion 34 is formed between the inner scroll chamber 31 and the first stage centrifugal impeller 23, extending from the outlet of the first stage centrifugal impeller 23 to the outer side in the radial direction, whereby the gas accelerated by the first stage centrifugal impeller 23 is decelerated and pressurized, and introduced into the inner scroll chamber 31.

An opening through which the rotating shaft 28 extends is formed in the back side (left side in the drawing) of the inlet side housing 24.

Further, an outer scroll chamber 32 is formed in the inlet side housing 24, positioned on the outer side in the radial direction than the inner scroll chamber 31.

Figure 5:
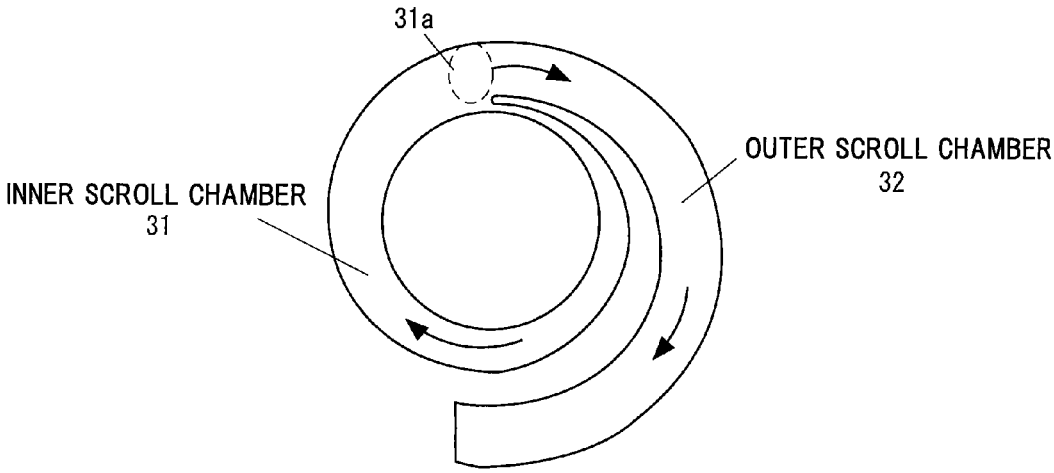
FIG. 5 is a view showing a shape of an inner scroll chamber and an outer scroll chamber in a cross section taken along a line A-A in FIG. 4.

FIG. 5 is a view showing a shape of the inner scroll chamber 31 and the outer scroll chamber 32 in a cross section taken along a line A-A in FIG. 4. As shown in this drawing, the outer scroll chamber 32 is formed so as to communicate with an outlet portion 31*a* of the inner scroll chamber 31. The outer scroll chamber 32 circumferentially extends so as to at least partially surround the inner scroll chamber 31. In the illustrated embodiment, the outer scroll chamber 32 is formed to surround about one half of the inner scroll chamber 31 around the inner scroll chamber 31.

Further, as shown in FIG. 4, an outlet flow path 33 is formed in the inlet side housing 24 to communicate with an end portion of the outer scroll chamber 32 and being open to the outlet side housing 27. The outlet flow path 33 is formed so as to communicate with an introduction flow path 41 mentioned below provided in the outlet side housing 27.

Further, the inlet side housing 24 or the outlet side housing 27 is provided with a gas supply port (not shown in the drawing) for supplying the coolant gas from the economizer 19 mentioned above to the gas flow path between the first stage centrifugal impeller 23 and the second stage centrifugal impeller 26. By this structure, the coolant gas from the economizer 19 is mixed with the coolant gas compressed by the first stage centrifugal impeller 23 so as to supply the mixed gas to the second stage centrifugal impeller 26.

Further, the outlet flow path 33 mentioned above is formed integrally with the inlet side housing 24 together with the other flow paths (outer scroll chamber 32 and the like) within the inlet side housing 24, by a cast integral structure.

As shown in FIG. 4, the introduction flow path 41, a suction scroll chamber 42 and a suction passage 43 are formed in the outlet side housing 27.

The introduction flow path 41 is open at the side of the inlet side housing 24 so as to communicate with the outlet flow path 33 mentioned above. By this structure, the introduction flow path 41 introduces the coolant gas from the first stage compression stage 21A to the outlet side housing 27.

The suction scroll chamber 42 is formed so as to surround the periphery of the rotating shaft 28 annularly and causes the gas from the introduction flow path 41 to expand in the circumferential direction.

The suction passage 43 is formed annularly so as to guide the gas in the suction scroll chamber 42 radially inward, and then to change its course toward the first stage centrifugal impeller 23 to introduce the gas to the second stage centrifugal impeller 26.

Further, an annular outlet side scroll chamber 46 is formed in the outlet side housing 27, surrounding the second stage centrifugal impeller 26. Between the outside scroll chamber 46 and the second stage centrifugal impeller 26, there is formed an annular outside diffuser portion 47 extending in a radial direction from an outlet of the second stage centrifugal impeller 26. The annular outside diffuser portion 47 decelerates and pressurizes the gas accelerated by the second stage centrifugal impeller 26 to introduce the decelerated and pressurized gas to the outside scroll chamber 46.

An opening through which the rotating shaft 28 extends is formed in the back side (right side in the drawing) of the outlet side housing 27.

Further, the introduction flow path 41 mentioned above is formed integrally with the outlet side housing 27 together with the other flow paths (suction scroll chamber 42 and the like) within the outlet side housing 27, by a cast integral structure.

In this case, the outlet flow path 33 and the introduction flow path 41 mentioned above may be pipes that are structures separate from the inlet side housing 24 and the outlet side housing 27. However, if the outlet flow path 33 and the introduction flow path 41 are the cast integral structure as in the present embodiment, it is possible to reduce the cost on the basis of reduction of the parts number and the assembling work, and a minimum flow path structure can be achieved, whereby a compact structure can be obtained.

Bearings 50 rotatably supporting the rotating shaft 28 about the axis X are arranged in the inlet side housing 24 and the outlet side housing 27 mentioned above.

In the present embodiment, the bearings 50 comprise bearings separately supporting a radial load and a thrust load applied to the rotating shaft 28. In other words, the bearings 50 comprises cylindrical roller bearings 51 and 52 supporting the radial load applied to the rotating shaft 28 at two axially spaced apart supporting positions, respectively, and a thrust bearing 53 supporting the thrust load applied to the rotating shaft 28. The thrust bearing 53 may be constituted by a slide bearing or a rolling bearing.

In the bearings 50, the cylindrical roller bearing 51 (hereinafter, refer to as "first bearing" as well) supporting the rotating shaft 28 at one of the supporting positions is arranged between the first stage centrifugal impeller 23 and the second stage centrifugal impeller 26. Further, in the bearings 50, the cylindrical roller bearing 52 (hereinafter, refer to as "second bearing" as well) supporting the other of the supporting positions is arranged on the opposite side from the first stage centrifugal impeller 23 with respect to the second stage centrifugal impeller 26 in the axial direction. Lubricating oil is supplied to these bearings 51, 52 and 53 by an oil feeding structure (not shown in the drawing), whereby the lubrication thereof is secured.

One cylindrical roller bearing 51 is fixed to a bearing retaining portion 56 provided in the outlet side housing 27.

However, the bearing retaining portion 56 may be provided in the inlet side housing 24. The thrust bearing 53 may be constituted by a slide bearing or a rolling bearing.

Further, as shown in FIG. 4, in the present embodiment, the speed increasing mechanism 70 is arranged between the second stage centrifugal impeller 26 and the second bearing 52.

In this case, in the present embodiment, the first bearing 51 is arranged between the first stage centrifugal impeller 23 and the second stage centrifugal impeller 26 as mentioned above, however, this structure is hard to be achieved by the conventional turbo compressor 80 shown in FIG. 1.

That is, in the conventional turbo compressor, since two impellers are arranged in the same direction, and a return flow path is provided between two impellers around the rotating shaft for introducing the gas from the first stage impeller to a portion of the next impeller near the center thereof, there is a structural restriction such as that for providing an oil feeding structure as well as securing an installation space of the bearings, and it is hard to arrange the bearing between the impellers.

On the contrary, in the turbo compressor 20 in accordance with the present invention, since the first stage centrifugal impeller 23 and the second stage centrifugal impeller 26 are arranged in such an orientation that their back sides face to each other, and the outlet flow path 33 and the introduction flow path 41 for introducing the gas from the first stage centrifugal impeller 23 to the second stage centrifugal impeller 26 are provided in the radially outer sides of both of the impellers, a structural restriction for securing the installation space of the bearing and arranging the oil feeding structure is small. Accordingly, it is possible to easily arrange the bearing 51 between the first stage and second stage centrifugal impellers 23, 26.

Next, the operation of the turbo compressor 29 structured as mentioned above will be described.

During the operation of the turbo refrigerator 10 mentioned above, in the turbo compressor 20, the rotational driving force of the output shaft 61 of the motor 60 is transmitted to the rotating shaft 28 by the speed increasing mechanism, with the speed being increased, and the first stage centrifugal impeller 23 and the second stage centrifugal impeller 26 fixed to the rotating shaft 28 are rotationally driven.

The coolant gas from the evaporator 18 is sucked from the suction port 29*a* of the inlet side housing 24, and is accelerated by the first stage centrifugal impeller 23. The accelerated coolant gas is decelerated and pressurized in the course of passing through the inside diffuser portion 34, and sequentially introduced into the inner scroll chamber 31 and the outer scroll chamber 32.

The coolant gas passing through the outer scroll chamber 32 gives way to the outlet side housing 27 from the inlet side housing 24 through the outlet flow path 33 and the introduction flow path 41, and is introduced into the second stage centrifugal impeller 26 through the suction scroll chamber 42 and the suction passage 43 to be accelerated.

The accelerated coolant gas is decelerated and pressurized in the course of passing through the outside diffuser portion 27 so as to have the higher temperature and the higher pressure, and introduced into the outside scroll chamber 46, and the coolant gas is thereafter discharged from the discharge portion (not shown) so as to be introduced to the condenser mentioned above.

Next, the description will be given of the operation and the effect of the turbo compressor 20 in accordance with the present embodiment.

In accordance with the turbo compressor 20 of the present embodiment, since the first stage centrifugal impeller 23 and the second stage centrifugal impeller 26 are arranged in such an orientation that their back sides face to each other, the thrust forces applied to both the impellers are generated on the opposite directions to each other. Accordingly, since the thrust forces applied to both the impellers are cancelled and reduced, and the thrust load applied to the bearings 50 is widely reduced, it is possible to reduce the mechanical loss in the bearing part. Therefore, it is possible to elongate the service life of the bearing 50.

Further, since the bearings are categorized into the bearing supporting the radial load and the bearing supporting the thrust load, it is possible to select optimum bearings while tacking the loss and the service life into consideration in correspondence to the respective loads.

In the present invention, since the thrust load is reduced as mentioned above, the thrust load is supported only by the thrust bearing, and the bearings supporting the radial load can be constituted by the cylindrical roller bearings 51 and 52. Accordingly, since it is not necessary to use many bearing members in combination as in the case of the angular ball bearing, and it is possible to reduce the number of the bearings to be used, it is possible to make the structure of the bearing portion compact, and it is possible to reduce the mechanical loss in the bearing portion.

Further, since the cylindrical roller bearings 51 and 52 can support the larger radial load than ball bearings, it is possible to make the bearings smaller than the ball bearings in the case of supporting the same radial load.

Further, since the bearing 51 supporting the rotating shaft 28 at one of the supporting positions is arranged between the first stage centrifugal impeller 23 and the second stage centrifugal impeller 26, the amount of overhang of the rotating shaft 28 is reduced. Accordingly it is possible to increase the critical speed without shortening the axial length of the impellers. Further, since it is possible to arrange the bearing in the thin shaft portion over which the impellers are inserted, it is possible to suppress the curvature of the rotating shaft 28, and the rigidity is increased.

Further, since the bearing supporting the rotating shaft 28 at the other of the supporting positions is arranged on the opposite side from the first stage centrifugal impeller 23 with respect to the second stage centrifugal impeller 26 in the axial direction, it is possible to make the shaft portion at this supporting position thicker, and the rigidity is increased.

Further, since the speed increasing mechanism is arranged between the second stage centrifugal impeller 26 and the bearing supporting the rotating shaft 28 at the other of the supporting positions, it is possible to suppress the deflection of the rotating shaft 28 due to the reaction force of the speed increasing mechanism 70.

Second Embodiment

The description will be given below of a turbo compressor 20 in accordance with a second embodiment of the present invention.

Figure 6:
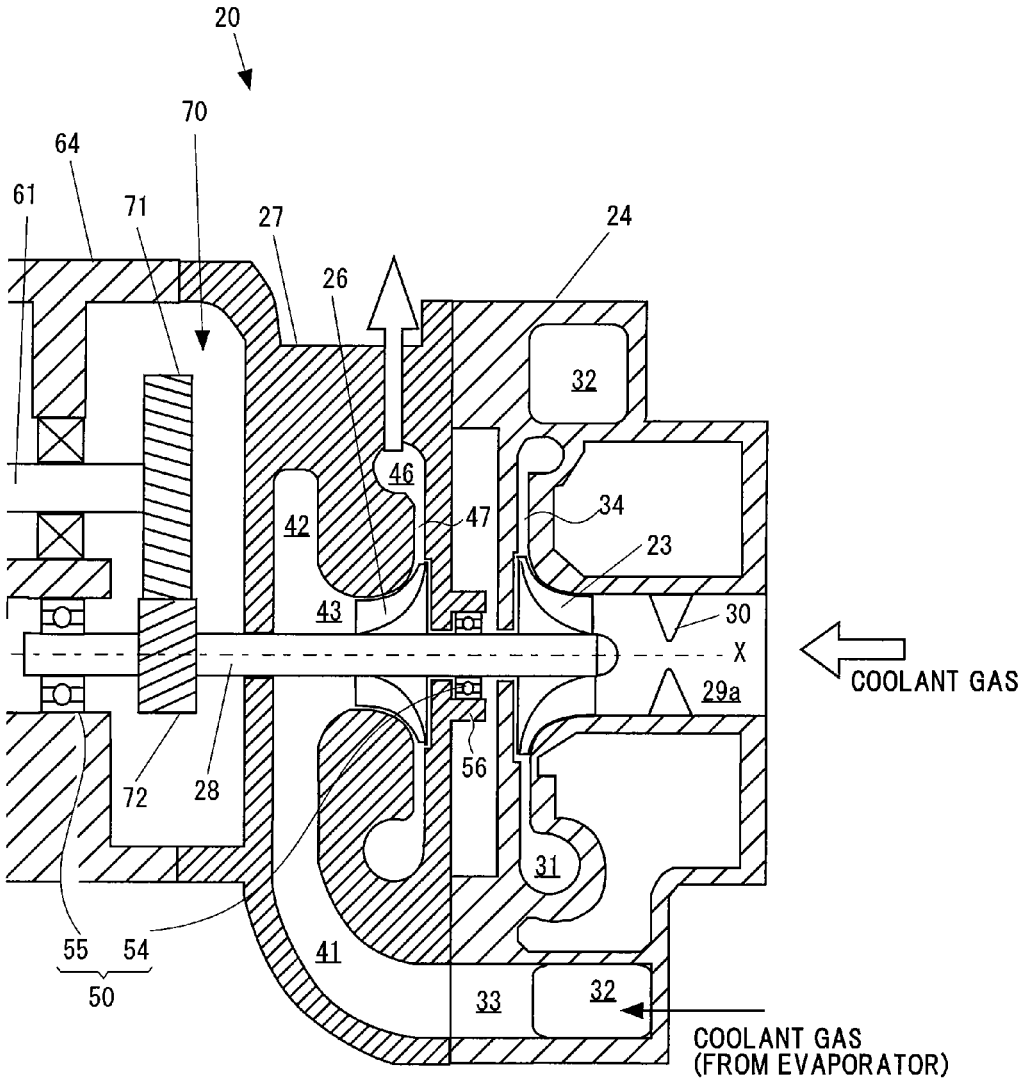
FIG. 6 is a partial enlarged view showing a structure of a turbo compressor in accordance with a second embodiment of the present invention.

FIG. 6 is a partly enlarged cross sectional view showing a structure of the turbo compressor 20 in accordance with the second embodiment.

As shown in FIG. 6, in accordance with the present embodiment, the bearings 50 are bearings commonly supporting the radial load and the thrust load applied to the rotating shaft 28, and comprise deep groove ball bearings 54 and 55 supporting the rotating shaft 28 at two axially spaced apart supporting positions, respectively. However, the deep groove ball bearing may be provided at any one of two supporting positions, and the other kind of bearing (for example, cylindrical roller bearing) may be provided at the other of the supporting positions, to support the rotating shaft 28.

In the bearings 50, the deep groove ball bearing 54 (hereinafter, refer to as "first deep groove ball bearing" as well) supporting the rotating shaft 28 at the one of the supporting positions is arranged between the first stage centrifugal impeller 23 and the second stage centrifugal impeller 26. Further, in the bearings 50, the deep groove ball bearing 55 (hereinafter, refer to as "second deep groove ball bearing" as well) supporting the rotating shaft 28 at the other of the supporting positions is arranged on the opposite side from the first stage centrifugal impeller 23 with respect to the second stage centrifugal impeller 26 in the axial direction. The lubricating oil is supplied to the bearings 54 and 55 by an oil feeding structure (not shown in the drawing) for securing the lubrication.

Further, as shown in FIG. 6, the speed increasing mechanism 70 in the present embodiment is arranged between the deep groove ball bearings 54 and 55 supporting two supporting positions, in the same manner as the first embodiment.

In this case, the structures of the other portions of the turbo compressor in accordance with the present embodiment are the same as those of the first embodiment mentioned above.

In accordance with the turbo compressor 20 of the present embodiment, since the first stage centrifugal impeller 23 and the second stage centrifugal impeller 26 are arranged in such an orientation that their back sides face to each other, the thrust load applied to the bearings 50 is widely reduced as mentioned above, so that it is possible to reduce the mechanical loss in the bearing 50.

Further, since the thrust load in the bearings 50 can be widely reduced, and it is not necessary to use many bearing members in combination as in the case of the angular ball bearing, on the basis of the employment of deep groove ball bearings 54 and 55, it is possible to reduce the number of the bearings to be used, so that it is possible to reduce the mechanical loss in the bearing. Accordingly, it is possible to elongate the service life of the bearing.

Further, since the deep groove ball bearing 54 supporting the rotating shaft 28 at the one of the supporting positions is arranged between the first stage centrifugal impeller 23 and the second stage centrifugal impeller 26, it is possible to increase the critical speed without shortening the axial length of the impellers.

In addition, regarding the common portions with the first embodiment, the same operations and effects as those of the first embodiment can be obtained.

Third Embodiment

Figure 7:
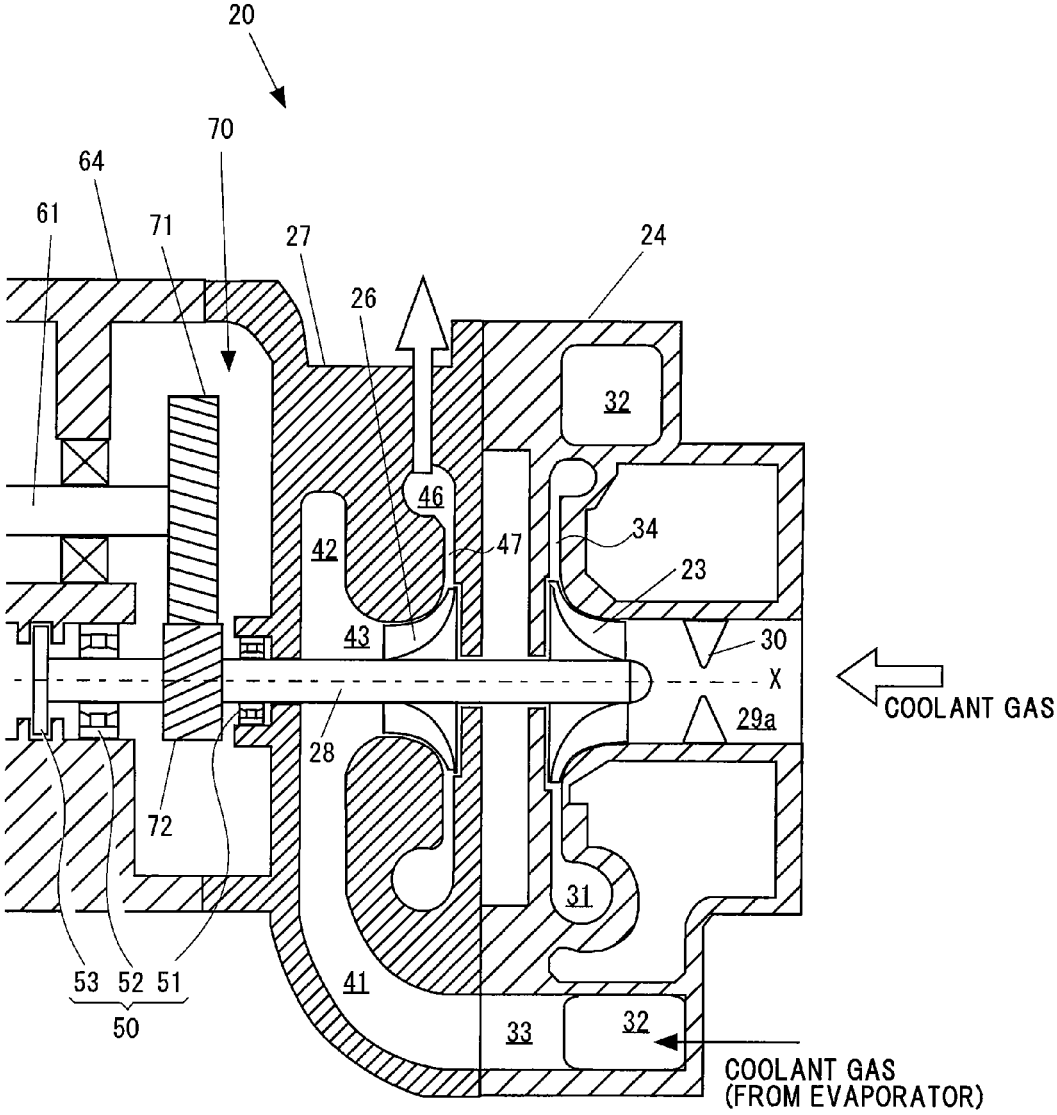
FIG. 7 is a partial enlarged view showing a structure of a turbo compressor in accordance with a third embodiment of the present invention.

The description will be given below of a turbo compressor in accordance with a third embodiment of the present invention. FIG. 7 is a partly enlarged cross sectional view showing a structure of the turbo compressor 20 in accordance with the third embodiment.

As shown in FIG. 7, in the present embodiment, the bearings 50 are constituted by the cylindrical roller bearings 51 and 52 supporting the radial load applied to the rotating shaft 28 at respective two axially spaced supporting positions, respectively, and the thrust bearing 53 supporting the thrust load applied to the rotating shaft 28.

With regard to axial positions of the rotating shaft 28, all of these bearings are arranged at the positions on the opposite side from the first stage centrifugal impeller 23 with respect to the second stage centrifugal impeller 26 in the axial direction (left positions from the second stage centrifugal impeller 26 in this drawing).

Further, as shown in FIG. 7, the speed increasing mechanism 70 in the present embodiment is arranged between the cylindrical roller bearings 51 and 52 supporting the rotating shaft 28 at two supporting positions.

The structures of the other portions of the turbo compressor 20 in accordance with the present embodiment are the same as those of the first embodiment mentioned above.

In the present embodiment, the bearing supporting the rotating shaft 28 at the one of the supporting positions is not arranged between the first stage centrifugal impeller 23 and the second stage centrifugal impeller 26 as in the first embodiment, but even in the turbo compressor 20 in accordance with the present embodiment, since the first stage centrifugal impeller 23 and the second stage centrifugal impeller 26 are arranged in such an orientation that their back sides face to each other, the thrust load applied to the bearings 50 can be widely reduced as mentioned above, so that it is possible to reduce the mechanical loss in the bearing 50.

Further since the thrust load is supported only by the thrust bearing, and the cylindrical roller bearings 51 and 52 are employed as the bearings supporting the radial load, it is not necessary to use many bearing members in combination as in the case of the angular ball bearing, and it is possible to reduce the number of the bearings to be used. Therefore, it is possible to make the structure of the bearing part compact, and it is possible to reduce the mechanical loss in the bearing portion.

Further, since the cylindrical roller bearings 51 and 52 can support the larger radial load than the ball bearings, it is possible to make the bearings smaller than the ball bearings in the case of supporting the same radial load.

Also, the cylindrical roller bearings 51 and 52 mentioned above may be replaced by the deep groove ball bearings. In this case, the thrust bearing 53 is omitted. Further, in this case, it is possible to obtain the same operation and effect as those obtained by employing the deep groove ball bearings described in the second embodiment.

Other Embodiments

In the first and second embodiments mentioned above, the kind of the bearings 50 is limited, however, in the further embodiments, it is possible that the kind of the bearings 50 is not particularly limited and the remaining structure except for the bearings is constructed in the same manner as that of the first or second embodiment. In this case, the bearings can be selected from a slide bearing, a rolling bearing, a gas bearing, a magnetic bearing or the like.

In these further embodiments as mentioned above, since the bearing supporting the rotating shaft at the one of the supporting positions is arranged between the first stage centrifugal impeller 23 and the second stage centrifugal impeller 26, the amount of overhang of the rotating shaft 28 is reduced, and there can be obtained an excellent effect that it is possible to increase the critical speed without shortening the axial length of the impellers.

Further, in the first and second embodiments mentioned above, the second bearing 52 and the second deep groove ball bearing 55 are arranged on the opposite side from the second stage centrifugal impeller 26 with respect to the position of the small gear 72 of the speed increasing mechanism 70. However, the second bearing 52 and the second deep groove ball bearing 55 may be arranged between the small gear 72 and the second stage centrifugal impeller 26 (for example, the position of "first bearing 51" shown in FIG. 7), in place of the arrangement mentioned above.

Further, in each of the embodiments mentioned above, the first stage centrifugal impeller 23 and the second stage centrifugal impeller 26 are arranged such that the first stage centrifugal impeller 23 is remoter than the second stage centrifugal impeller 26 from the position where the driving force is transmitted to the rotating shaft 28 from the motor 60. Contrary to this, the first stage centrifugal impeller 23 and the second stage centrifugal impeller 26 may be arranged such that such that the second stage centrifugal impeller 26 is remoter than the first stage centrifugal impeller 23 from the position where the driving force is transmitted to the rotating shaft 28 from the motor 60. In other words, the first compression stage 21A and the second compression stage 21B may be arranged inversely to the arrangement of each embodiment mentioned above with respect to the position where the driving force is transmitted to the rotating shaft 28.

As is apparent from the description in each of the embodiments mentioned above, in accordance with the turbo compressor of the present invention, there can be obtained an excellent effect that it is possible to increase the critical speed without shortening the axial length of the impellers as well as it is possible to elongate the service life of the bearings by reducing the mechanical loss in the bearing portion.

In this case, it goes without saying that the present invention is not limited to the embodiments mentioned above, but can be variously modified within the scope of the present invention.

What is claimed is:

1. A turbo compressor comprising:

a rotating shaft provided in a housing and rotationally driven by a drive source;

bearings rotatably supporting the rotating shaft; and a first centrifugal impeller and a second centrifugal impeller arranged on the rotating shaft to be axially spaced from each other, wherein the first centrifugal impeller and the second centrifugal impeller are arranged in such an orientation that back sides of the first centrifugal impeller and the second centrifugal impeller face to each other, and the bearings are cylindrical roller bearings and a thrust bearing, the cylindrical roller bearings being arranged at two axially spaced supporting positions respectively and supporting a radial load applied to the rotating shaft, the thrust bearing supporting a thrust load applied to the rotating shaft.

2. The turbo compressor according to claim 1, wherein the first centrifugal impeller and the second centrifugal impeller are arranged in this order from one end side of the rotating shaft, the rotating shaft is structured such that a driving force is transmitted thereto at a position on the opposite side from the first centrifugal impeller with respect to the second centrifugal impeller in the axial direction, and the bearing supporting the rotating shaft at one of the supporting positions is arranged between the first centrifugal impeller and the second centrifugal impeller, and the bearing supporting the rotating shaft at the other of the supporting positions is arranged on the opposite side from the first centrifugal impeller with respect to the second centrifugal impeller in the axial direction.

3. The turbo compressor as claimed in claim 1, further comprising a speed increasing mechanism for transmitting the rotational driving force output from the drive source to the rotating shaft while increasing the rotational speed output by the drive source, wherein the speed increasing mechanism is arranged between the second centrifugal impeller and the bearing supporting the rotating shaft at one of the two supporting positions.

4. The turbo compressor as claimed in claim 2, further comprising a speed increasing mechanism for transmitting the rotational driving force output from the drive source to the rotating shaft while increasing the rotational speed output by the drive source, wherein the speed increasing mechanism is arranged between the second centrifugal impeller and the bearing supporting the rotating shaft at the other of the supporting positions.

5. A turbo compressor comprising:

a rotating shaft provided in a housing and rotationally driven by a drive source;

bearings rotatably supporting the rotating shaft; and a first centrifugal impeller and a second centrifugal impeller arranged on the rotating shaft to be axially spaced from each other, wherein the first centrifugal impeller and the second centrifugal impeller are arranged in such an orientation that back sides of the first centrifugal impeller and the second centrifugal impeller face to each other, and the bearings support the rotating shaft at two axially spaced supporting positions, and at least one of the bearings is a deep groove ball bearing, further comprising a speed increasing mechanism for transmitting the rotational driving force output from the drive source to the rotating shaft while increasing the rotational speed output by the drive source, wherein the speed increasing mechanism is arranged between the second centrifugal impeller and the bearing supporting the rotating shaft at one of the two supporting positions.

6. A turbo compressor comprising:

a rotating shaft provided in a housing and rotationally driven by a drive source;

bearings rotatably supporting the rotating shaft; and a first centrifugal impeller and a second centrifugal impeller arranged on the rotating shaft to be axially spaced from each other, wherein the first centrifugal impeller and the second centrifugal impeller are arranged in such an orientation that back sides of the first centrifugal impeller and the second centrifugal impeller face to each other, and the bearings support the rotating shaft at two axially spaced supporting positions, and at least one of the bearings is a deep groove ball bearing, wherein the first centrifugal impeller and the second centrifugal impeller are arranged in this order from one end side of the rotating shaft, and the rotating shaft is structured such that a driving force is transmitted thereto at a position on the opposite side from the first centrifugal impeller with respect to the second centrifugal impeller in the axial direction, and the bearing supporting the rotating shaft at one of the supporting positions is arranged between the first centrifugal impeller and the second centrifugal impeller, and the bearing supporting the rotating shaft at the other of the supporting positions is arranged on the opposite side from the first centrifugal impeller with respect to the second centrifugal impeller in the axial direction, further comprising a speed increasing mechanism for transmitting the rotational driving force output from the drive source to the rotating shaft while increasing the rotational speed output by the drive source, wherein the speed increasing mechanism is arranged between the second centrifugal impeller and the bearing supporting the rotating shaft at the other of the supporting positions.

* * * * *